United States Patent [19]

Bewley, Jr. et al.

[11] Patent Number: 4,864,682

[45] Date of Patent: Sep. 12, 1989

[54] SELF-ADJUSTING WIPER STRIP ASSEMBLY FOR A VACUUM CLEANER

[75] Inventors: Wilbur C. Bewley, Jr., Lexington; Kendell S. Lahndorff, Harrodsburg; Jeffrey M. Nauman, Danville, all of Ky.

[73] Assignee: Whirlpool Corporation, Benton Harbor, Mich.

[21] Appl. No.: 188,965

[22] Filed: May 2, 1988

[51] Int. Cl.[4] ..... A47L 9/02

[52] U.S. Cl. ..... 15/371; 15/364; 15/401

[58] Field of Search ..... 15/401, 354, 359, 245, 15/246, 371, 364

[56] References Cited

U.S. PATENT DOCUMENTS

| | | | |
|---|---|---|---|
| 3,460,188 | 8/1969 | Boyd | 15/401 X |
| 4,075,730 | 2/1978 | Siemund | 15/245 |
| 4,607,411 | 8/1986 | Lewis | 15/245 X |

*Primary Examiner*—Chris K. Moore

*Attorney, Agent, or Firm*—Mason, Kolehmainen, Rathburn & Wyss

[57] ABSTRACT

A self-adjusting wiper strip assembly for use with a vacuum cleaner includes a surface engaging wiper strip made of a relatively soft, compliant plastic material. The wiper strip includes a colored tip portion; when the colored tip portion wears off, an operator is alerted to the need to replace the wiper strip assembly. The wiper strip is connected to a relatively hard, plastic rigid component that provides rigidity to the wiper strip. The rigid component is connected by a relatively soft, flexible, web-like plastic hinge component to a relatively hard, plastic attachment component that removably, securely attaches the wiper strip assembly to the vacuum cleaner. The hinge component automatically enables the wiper strip to move vertically with respect to the attachment component so that the wiper strip automatically adjusts its vertical position depending on the type of surface being cleaned by the vacuum cleaner.

15 Claims, 1 Drawing Sheet

SELF-ADJUSTING WIPER STRIP ASSEMBLY FOR A VACUUM CLEANER

BACKGROUND OF THE INVENTION

A. Field of the Invention

The present invention generally relates to vacuum cleaners and, more particularly, to a new and improved vacuum cleaner having a self-adjusting wiper strip assembly that automatically adjusts for the type of floor surface on which the vacuum cleaner is being used.

B. Description of the Prior Art

Vacuum cleaners are often operated on different floor surfaces such as bare floors and carpeting. Upright vacuum cleaners and modern canister vacuum cleaners have floor cleaning units with rotatable brushes or agitators positioned in the front portions of the floor cleaning units in front of suction inlet ducts. Each such agitator is rotated to propel dirt or debris on the bare floor or on carpeting rearwardly in the direction of the suction inlet duct. As a result, at least a portion of the dirt and debris propelled by the agitator enters the inlet duct while another portion may be propelled rearwardly of the floor cleaning unit and not enter the inlet duct. Therefore, a need exists for a vacuum cleaner mechanism, adaptable to different floor surfaces, for enhancing the collection of dirt and debris through the suction inlet duct.

SUMMARY OF THE INVENTION

An object of the present invention is to provide a new and improved vacuum cleaner having a wiper strip assembly that is automatically adjustable vertically for different floor surfaces for enhancing the collection of dirt and debris by the vacuum cleaner.

Briefly, a new and improved vacuum cleaner has a floor cleaning unit and a dust collecting compartment energized by a suction motor. When the vacuum cleaner is turned on, the motor creates suction so that dirt and debris flow through an inlet duct in the floor cleaning unit and eventually into a dust bag disposed in the dust collecting compartment. A rotatable brush or agitator is positioned in front of and adjacent to the inlet duct in the floor cleaning unit. As the agitator is rotated, it propels dirt and debris from the surface on which the vacuum cleaner is being used rearwardly towards the inlet duct. In order to maximize the amount of dirt and debris entering the inlet duct and to minimize the amount of dirt and debris propelled rearwardly of the floor cleaning unit, a self-adjusting wiper strip assembly is provided adjacent the rear of the inlet duct.

The wiper strip assembly is made of conventional coextruded, molded plastic materials and includes components having different hardnesses. The wiper strip assembly includes a floor engaging wiper strip made of a relatively soft or compliant plastic material and designed to move along and contact the surface being cleaned. The wiper strip may have a colored tip portion; when the colored tip portion wears off, an operator can be alerted to the need to replace the wiper strip. The wiper strip is connected to a relatively harder, rigid, plastic component that provides rigidity to the wiper strip. The rigid component is connected to a relatively soft, flexible, web-like plastic hinge component that extends between the rigid component and a relatively hard plastic attachment component. The attachment component has resilient fingers that securely engage and attach to a base portion of the floor planing unit. The hinge component enables the vertical position of the wiper strip to be automatically adjusted depending upon the type of surface being cleaned.

BRIEF DESCRIPTION OF THE DRAWING

The above and other objects, advantages and novel features of the present invention will become apparent from the following detailed description of the preferred embodiment of the present invention illustrated in the accompanying drawing wherein.

DESCRIPTION OF THE PREFERRED EMBODIMENT

Figures 1, 2, 3, 4:
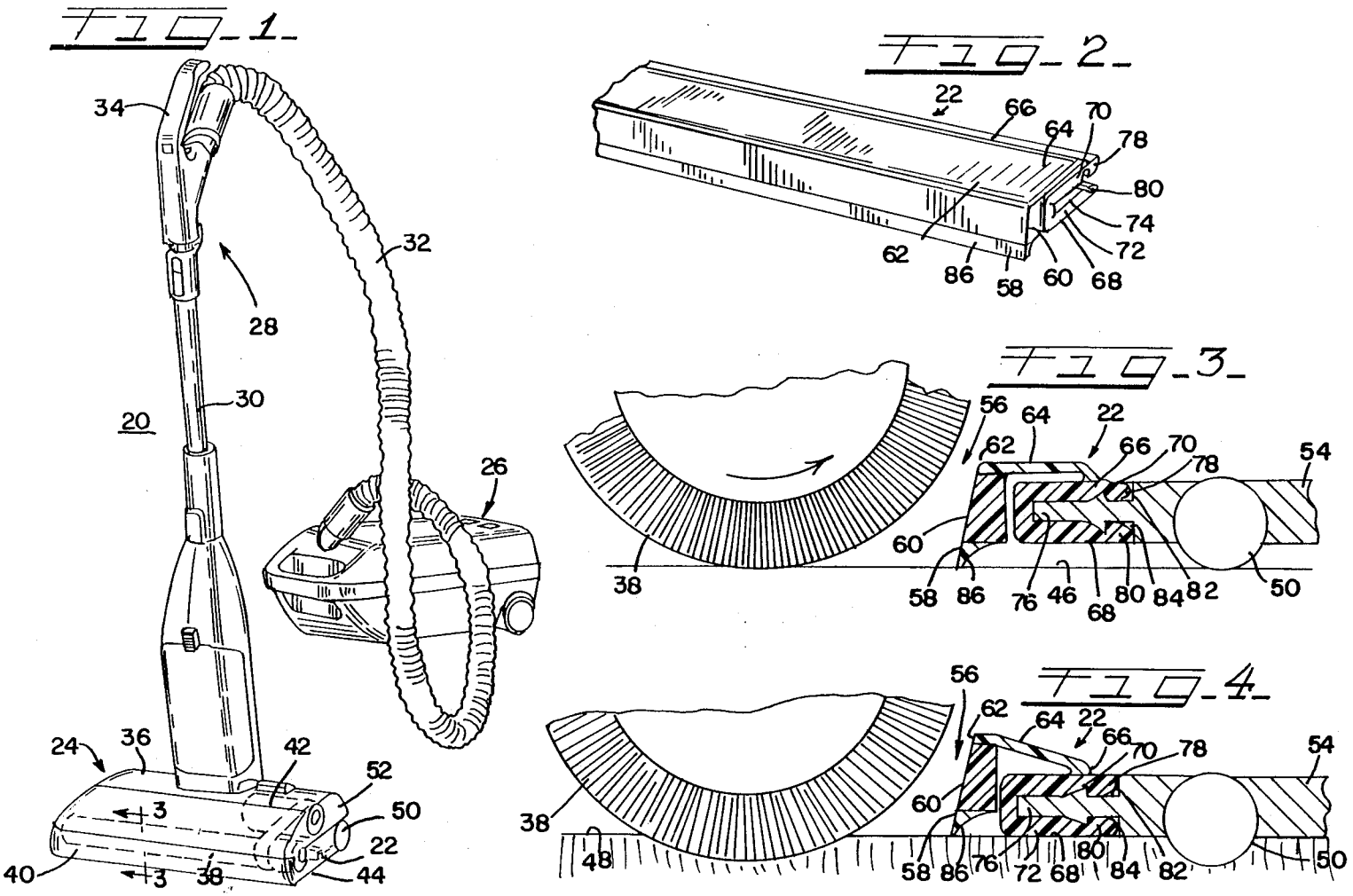
FIG. 1 is a perspective view of a vacuum cleaner having a wiper strip assembly constructed in accordance with the principles of the present invention.
FIG. 2 is an enlarged, fragmentary perspective view of the wiper strip assembly of FIG. 1.
FIG. 3 is an enlarged, partial cross-sectional view of a portion of the floor cleaning unit of the vacuum cleaner of FIG. 1 taken along line 3—3 of FIG. 1 illustrating the operation of the wiper strip assembly as used on a bare floor.
FIG. 4 is a view similar to FIG. 3 illustrating the operation of the wiper strip assembly used on a carpet.

Referring more specifically to FIG. 1, a canister vacuum cleaner 20 is illustrated having a wiper strip assembly 22 (shown in more detail in FIGS. 2–4), constructed in accordance with the principles of the present invention.

While shown in connection with the canister vacuum cleaner 20, the wiper strip assembly 22 may also form a component of a floor cleaning unit of an upright vacuum cleaner.

The canister vacuum cleaner 20 has a floor cleaning unit 24 and a canister 26 mechanically, pneumatically and electrically interconnected by a wand, wand handle and hose assembly 28.

The assembly 28 includes a rigid wand 30 connected to a flexible hose 32 by a wand handle 34. The wand handle 34 includes electrical controls for operating the vacuum cleaner 20. The canister 26 includes a suction motor (not shown) for developing suction or reduced pressure within a dust collecting compartment within the canister 26. The flexible hose 32 is inserted into the canister 26 so that the assembly 28 is pneumatically coupled to the dust collecting compartment.

The floor cleaning unit 24 includes an outer housing 36 in which a rotatable brush or agitator 38 is disposed near a front end 40 of the floor cleaning unit 24. The agitator 38 is driven by an electrical motor 42 disposed in the floor cleaning unit 24 through a conventional belt drive assembly 44. The floor cleaning unit 24 is moved along a surface (for example, a bare floor 46 in FIG. 3 or a carpet 48 in FIG. 4) on a plurality of wheels, such as the wheels 50. The particular locations of the motor 42 and of the belt drive assembly 44 and of the wheels 50 within the floor cleaning unit 24 are not germane to the principles of the present invention and may be varied as desired from those depicted for illustrative purposes only in FIGS. 1–4. For example, the motor 42 and the belt drive assembly 44 may be located on the opposite side of the housing 36 from the side depicted in FIG. 1, if desired.

When the vacuum cleaner 20 is turned on, the suction motor in the canister unit 26 evacuates or reduces the pressure in the dust collecting compartment to draw air into an inlet duct 56 (located to the rear of the agitator 38 in the floor cleaning unit 24), through the wand 30 (to which the inlet duct 56 is pneumatically connected), through the wand handle 34 and through the hose 32 into a dust bag (not shown) disposed in the dust collecting compartment. As a result, dirt and debris on the bare floor 46 or the carpet 48 are drawn into the inlet duct 56 and eventually pass into the dust bag disposed in the dust collecting compartment.

In order to pick up dirt and debris from the bare floor 46 or to agitate the pile of the carpet 48, the brush 38 is rotated in a counterclockwise direction (FIGS. 3 and 4), thereby propelling dirt and debris rearwardly in the direction of the inlet duct 56 for removal from the floor 46 or the carpet 48 by the suction present in the inlet duct 56.

In accordance with an important feature of the present invention, in order to maximize the amount of dirt and debris received in the inlet duct 56 and to minimize the amount of dirt and debris propelled rearwardly of the rear end 52 of the floor cleaning unit 24, the wiper strip assembly 22 (FIGS. 2–4) is disposed at the rear of the inlet duct 56 and forms an inclined surface to facilitate the collection of dirt and debris by the vacuum cleaner 20. The wiper strip assembly 22 is made of conventional coextruded, molded plastic materials and has four basic components with different hardnesses. The specific plastic materials selected for use in making the components of the assembly 22 depend on a number of factors including, inter alia, desired material hardnesses and wear characteristics or longevity.

A floor engaging wiper strip 58 is designed to contact and wipe the bare floor 46 (FIG. 3) or the top edge of the pile of the carpet 48 (FIG. 4) as the floor cleaning unit 24 is moved therealong. The wiper strip 58 is made of a relatively soft, compliant plastic material enabling it to maintain contact with the bare floor 46 or the carpet 48. The wiper strip 58 is connected to a relatively harder, rigid, plastic component 60 that provides rigidity to the wiper strip 58. The rigid component 60 is in turn connected along an edge 62 to a relatively soft, flexible, web-like plastic hinge component 64, that is coupled at its other end 66 to a relatively harder, rigid plastic attachment component 68. As an example, the exterior surfaces of the components 58 and 64 may be of essentially the same hardness, as measured on any standard materials hardness scale, substantially less than the hardness of the exterior surfaces of the components 60 and 68, the hardness of which may be the same or different, as desired for a particular application.

The attachment component 68 has a pair of opposed resilient fingers 70 and 72 on opposite sides of a formed slot 74 that enable the attachment component 68 to be removably secured about an elongate complimentarily shaped rigid portion 76 of the base member 54. The finger 70 has a projection or tip 78 and the finger 72 has a projection or tip 80 that snap into formed recesses 82 and 84, respectively, in the portion 76 of the base member 54. Because the fingers 70 and 72 are relatively resilient, the attachment component 68 can be removed from the base member 54 after the wiper strip 58 has become excessively worn. A tip 86 of the wiper strip 58 may be made in a different, distinctive color so that when the colored tip 86 is no longer visible due to wear, the operator knows that the wiper strip assembly 22 should be replaced.

When the floor cleaning unit 24 is used on the carpet 48, the wheels, for example, the wheels 50, may sink into the pile of the carpet 48 (FIG. 4). The hinge component 64 enables the wiper strip 58 automatically to move upwardly to ride along the top of the carpet 48. The wiper strip 58 automatically moves downwardly into contact with the bare floor 46 when the vacuum cleaner 20 is moved from the carpet 48 to the bare floor 46.

Obviously, many modifications and variations of the present invention are possible in light of the above teachings. For example, rather than forming the wiper strip assembly 22 as a coextruded integral assembly 22 of four components 58, 60, 64 and 68, those components could be individually formed and subsequently securely interconnected, by any suitable method, to form the assembly 22. Thus, it is to be understood that, within the scope of the appended claims, the invention may be practiced otherwise than as specifically described hereinabove.

What is claimed and is desired to be secured by Letters Patent is:

1. A wiper strip assembly for a vacuum cleaner for cleaning a surface comprising:

wiper strip means for maintaining engagement with said surface and for facilitating the collection of dirt and debris from said surface by said vacuum cleaner;

attachment means for mounting said wiper strip means to a portion of said vacuum cleaner in proximity to said surface, said attachment means being made of a relatively rigid plastic material and means connecting said wiper strip means to said attachment means for automatically enabling said wiper strip means to move relative to said attachment means to maintain contact with said surface, said connecting means being made of a relatively flexible plastic material, the surface hardness of which is less than the surface hardness of said attachment means.

2. A wiper strip assembly for a vacuum cleaner as set forth in claim 1 further including a relatively hard rigid means disposed between said connecting means and said wiper strip means for providing rigidity to said wiper strip means.

3. A wiper strip assembly for a vacuum cleaner as recited in claim 2 wherein said hard rigid means comprises an integrally formed portion of said wiper strip assembly.

4. A wiper strip assembly for a vacuum cleaner for cleaning a surface comprising:

wiper strip means for maintaining engagement with said surface and for facilitating the collection of dirt and debris from said surface by said vacuum cleaner;

attachment means for mounting said wiper strip means to a portion of said vacuum cleaner in proximity to said surface, said attachment means including opposed resilient fingers to removably secure said attachment means to said vacuum cleaner and means connecting said wiper strip means to said attachment means for automatically enabling said wiper strip means to move relative to said attachment means to maintain contact with said surface.

5. A self-adjusting wiper strip assembly for use in a vacuum cleaner for cleaning different floor surfaces, said wiper strip assembly comprising:

first means for removably attaching said wiper strip assembly to said vacuum cleaner;

second means for moving along and maintaining contact with said different floor surfaces, said second means having a tip portion for engaging said different floor surfaces, said tip portions being a color different than the remaining portion of said second means and third means for movably connecting said second means to said first means, said third means being flexible such that said first means is movable relative to said second means during operation of said vacuum cleaner on said different floor surfaces.

6. A self-adjusting wiper strip assembly for use in a vacuum cleaner for cleaning different floor surfaces, said wiper strip assembly comprising:

first means for removably attaching said wiper strip assembly to said vacuum cleaner;

second means for moving along and maintaining contact with said different floor surfaces, third means for movably connecting said second means to said first means, said third means being flexible such that said first means is movable relative to said second means during operation of said vacuum cleaner on said different floor surfaces; and fourth rigid means disposed between said second means and said third means for providing rigidity to said second means.

7. A self-adjusting wiper strip assembly for use in a vacuum cleaner for cleaning different floor surfaces as recited in claim 6 wherein said first, second and third means are integrally formed molded plastic portions of said wiper strip assembly.

8. A vacuum cleaner comprising:

floor cleaning means for cleaning different floor surfaces, said floor cleaning means including a base portion having a suction inlet duct formed therein, and a wiper strip assembly disposed on said base portion in proximity to said suction inlet duct, said wiper strip assembly including a relatively flexible wiper strip for movement along said floor surfaces, attachment means for mounting said wiper strip to said base portion in proximity to said suction inlet duct and flexible adjustment means connected to said attachment means for enabling the position of said wiper strip to be automatically adjusted for different floor surfaces and rigid means disposed between said flexible adjustment means and said wiper strip for providing rigidity to said wiper strip.

9. A vacuum cleaner as set forth in claim 8 wherein said wiper strip, said attachment means, said flexible adjustment means and said rigid means are integrally formed, plastic components of said wiper strip assembly.

10. A vacuum cleaner as set forth in claim 8 wherein said attachment means includes resilient finger means for removably attaching said attachment means to said base portion.

11. A vacuum cleaner as set forth in claim 8 wherein said adjustment means automatically adjusts the position of said wiper strip in a generally vertical direction depending on the levelness of the floor surface being cleaned by said vacuum cleaner.

12. A vacuum cleaner as recited in claim 11 wherein said wiper strip includes a relatively soft, colored tip portion for physically contacting said different floor surfaces, the color of said tip portion being visually noticeably different than the color of an adjacent portion of said wiper strip, thereby visually to indicate to an operator of said vacuum cleaner the amount of wear associated with said tip portion.

13. A method for minimizing the amount of dirt and debris propelled by a rotatable brush of a vacuum cleaner rearwardly of a suction inlet opening of said vacuum cleaner comprising the steps of forming a self-adjusting wiper strip assembly for said vacuum cleaner from a plurality of plastic components having different hardnesses and attaching said wiper strip assembly to said vacuum cleaner at the rearward end of said suction inlet opening such that at least one of said components is automatically movable relative to said suction inlet opening to maintain contact with different floor surfaces during operation of said vacuum cleaner on said different floor surfaces.

14. A method for minimizing the amount of dirt and debris propelled by a rotatable brush of a vacuum cleaner rearwardly of a suction inlet opening of said vacuum cleaner as recited in claim 13 wherein said forming step includes the steps of forming a first component of said components as a relatively flexible surface engaging component and forming a second component of said components as a relatively harder attachment component for attaching said wiper strip assembly to said vacuum cleaner and forming a third component of said components as a relatively flexible connecting component for connecting said first component to said second component.

15. A method for minimizing the amount of dirt and debris propelled by a rotatable brush of a vacuum cleaner rearwardly of a suction inlet opening of said vacuum cleaner as recited in claim 13 wherein one of said components is formed with a visually noticeably different color than another one of said components to provide a visual indication to an operator of said vacuum cleaner of the amount of wear associated with said tip portion.

* * * * *